United States Patent [19]

Sauer et al.

[11] 4,019,300

[45] Apr. 26, 1977

[54] SUSPENDED CEILING STRUCTURE

[75] Inventors: Gale E. Sauer, Williamsville; Barton Hansen, Cheektowaga, both of N.Y.

[73] Assignee: Roblin Industries, Inc., Buffalo, N.Y.

[22] Filed: Aug. 4, 1975

[21] Appl. No.: 601,726

[52] U.S. Cl. ..... 52/665; 52/484

[51] Int. Cl.[2] ..... E04B 5/52

[58] Field of Search ..... 52/665, 664, 484, 488, 52/489, 758 A, 715, 760, 633, 669, 660; 248/317

[56] References Cited

UNITED STATES PATENTS

| | | | |
|---|---|---|---|
| 2,770,336 | 11/1956 | Vevirit et al. | 52/665 X |
| 2,981,386 | 4/1961 | Reske et al. | 52/665 |
| 3,053,359 | 9/1962 | Stanley | 52/484 |
| 3,203,150 | 8/1965 | Serneblad | 52/665 X |
| 3,343,309 | 9/1967 | Netz et al. | 52/665 X |
| 3,602,473 | 8/1971 | Riet et al. | 52/484 |
| 3,778,947 | 12/1973 | Sauer | 52/664 |
| 3,785,110 | 1/1974 | Galloway et al. | 52/665 |
| 3,835,614 | 9/1974 | Downing | 52/484 |

*Primary Examiner*—J. Karl Bell
*Attorney, Agent, or Firm*—Christel & Bean

[57] ABSTRACT

A grid system for supporting a plurality of individual panel members generally in the same plane. A grid is formed of a plurality of structural beams or grid members which are disposed in intersecting relationship to each other in a predetermined geometric relation. More specifically, the grid system is adapted to be suspended from the superstructure of a building and includes a plurality of spaced, parallel grid members. Each pair of such grid members are adapted on their opposite sides to support the marginal edge portions of ceiling panels while the adjacent sides of each pair of grid members are appropriately spaced and formed to receive an outlet portion of an air handling conduit for conveying conditioned air from a plenum-like structure disposed between the grid system and the overhead building superstructure into the room below the grid structure. In this regard, one embodiment includes pairs of grid members disposed only in a longitudinal orientation over the room while a second embodiment includes spaced, parallel pairs of grid members disposed both longitudinally and transversely with respect to a room therebelow. In the former embodiment, single grid members are disposed transversely to the pairs of spaced, parallel grid members so as to provide support for the correspondingly transverse edges of supported ceiling panels. In the latter embodiment, an intersection clip means having separately attached intersecting clip connector means is provided for connecting intersecting longitudinal and transverse pairs of grid members.

21 Claims, 14 Drawing Figures

Fig. 1.
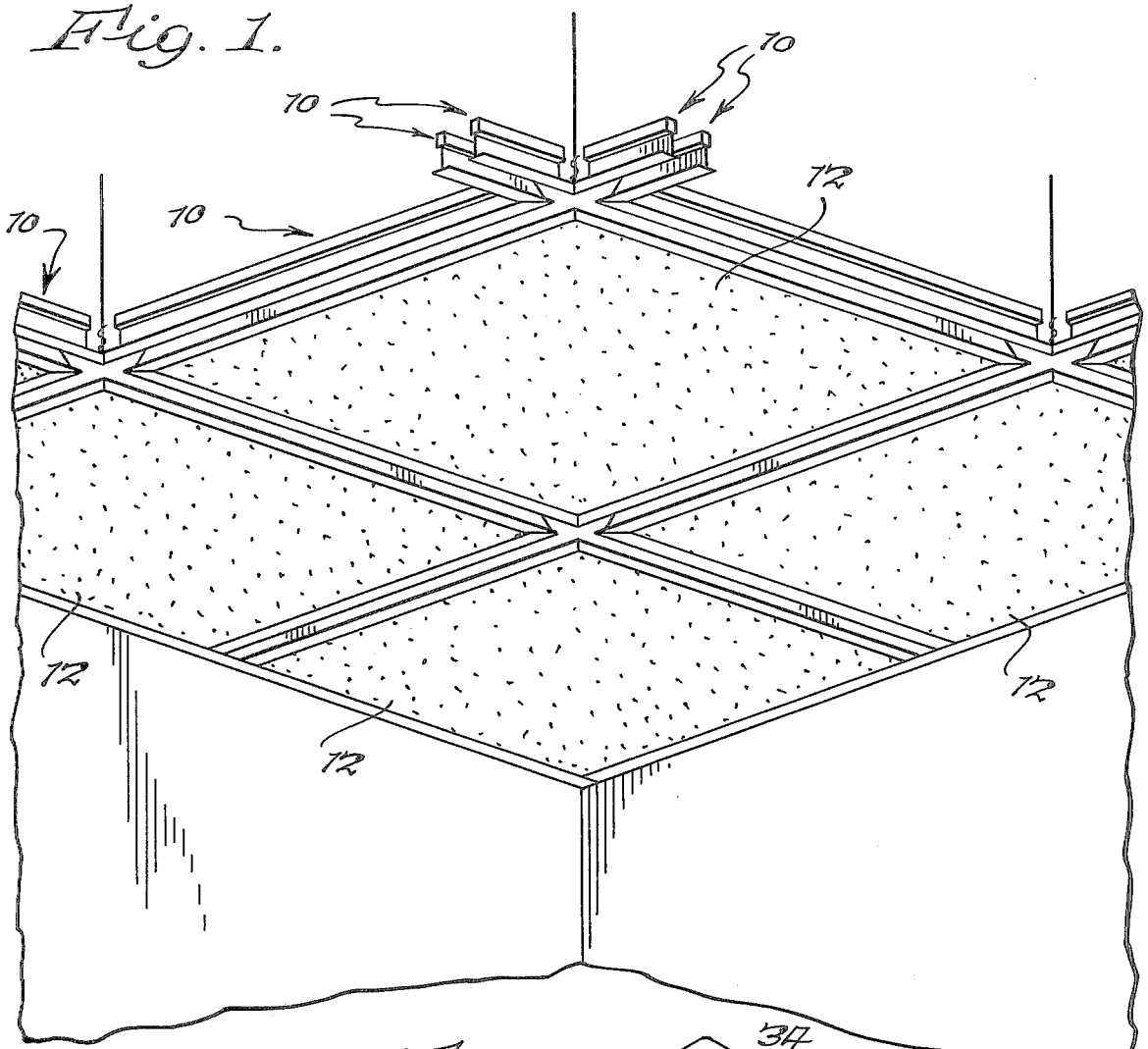
Fig. 3.
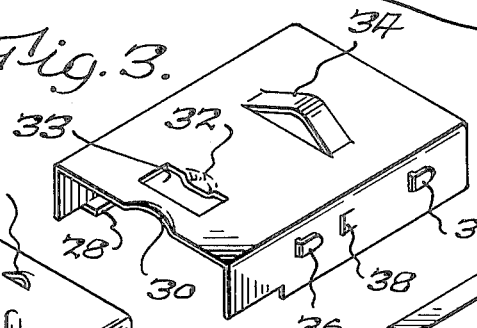
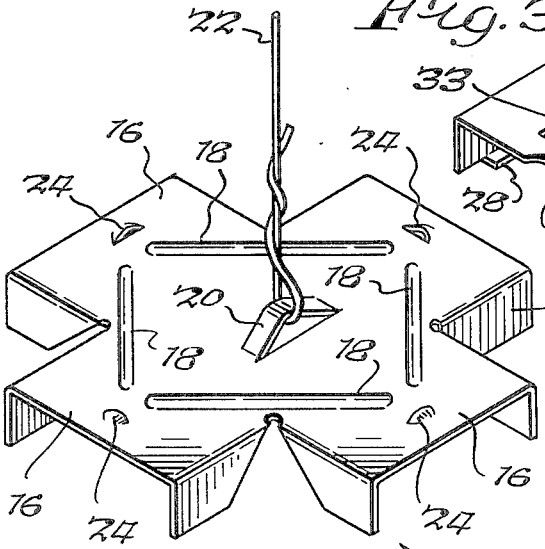
Fig. 2.
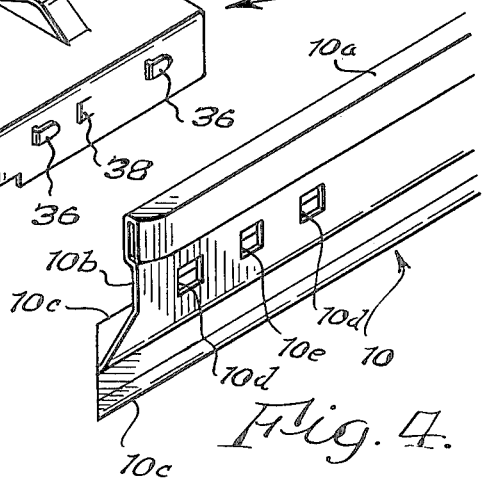
Fig. 4.

40
40a
70a
70
70c
72
74
76
78
50
52
54
22
11
11a
11b
11c

SUSPENDED CEILING STRUCTURE

BACKGROUND OF THE INVENTION

This invention relates to a structure which is adapted to support a plurality of individual panel members. More specifically, the present invention relates to a suspended ceiling grid structure which is adapted to receivably mount air handling conduits between the supported marginal edge portions of the individual ceiling panel members supported by the presently disclosed grid system.

Recent years have seen changes in the manner of internal room decoration and furnishing in which emphasis has been laid upon suspended ceilings or ceiling sections. Most usually, such structures are composed of a metallic grid of beam or grid members and panel members supported thereby such as acoustic tile members, which may or may not include flush lighting fixtures. The improvement of the present invention has particular utility in connection with suspended ceiling grid structures and, therefore will be discussed with particular reference thereto.

Concurrently with the development mentioned above, changes have been made in the manner in which conditioned air has been introduced to a room. Recently, use has been made of the space or plenum area formed between a suspended ceiling and the original room ceiling or building superstructure as a passage for conditioned air, and as regions from which such air can be introduced into the room therebelow.

One such method included in the prior art is to utilize a plurality of ventilated tiles in which holes have been drilled completely through such tiles to provide channels for the escape of conditioned air from a plenum chamber into the room below. However, such structures necessitate the use of modified ceiling tiles and involve the problem of uniformly directing conditioned air over the relatively large area of such perforated ceiling tiles.

Other structures for providing an air handling passageway from the open area above a suspended ceiling to the room below have involved extensive modification of the supporting grid beams or modification of the tile or panel members themselves along the marginal edges.

SUMMARY OF THE INVENTION

Accordingly, one object of the present invention is to provide a new and improved grid structure for a suspended ceiling wherein conditioned air may be easily conveyed from above the ceiling to the room below the suspended ceiling.

Another object of the present invention is to provide a new and improved grid system for a suspended ceiling which utilizes readily available, standard ceiling tile supporting grid members which support standard tile or panel members utilized in such suspended ceiling arrangements.

A further object of the present invention is to provide a suspended ceiling grid system which is adapted to readily receive air handling conduits for conveying conditioned air between the supported marginal edges of adjacent ceiling tiles.

Still another object of the present invention is to provide a grid system for a suspended ceiling wherein the aforesaid air handling conduits may be selectively positioned about the area of the suspended ceiling so as to yield desirable air flow characteristics within the room therebelow.

A still further object of the present invention is to provide the aforesaid grid system which is easily assembled while being subject to ready modification to suit the needs of any particular room layout.

In summary, the present invention provides a grid system having a plurality of pairs of standard T-shaped grid members adapted to support a plurality of individual panel members. The pairs of grid members are assembled in a spaced, substantially parallel manner with respect to one another and are adapted to receivably mount air handling conduits therebetween. Such air handling conduits communicate with an air handling system for conditioned air which is mounted in the plenum area above the suspended ceiling. The parallel pairs of grid members are disposed in intersecting, interlocking relationship so that the aforesaid air handling conduits my be selectively mounted over the area of the room. In this regard, one embodiment of the present invention includes pairs of grid members extending both longitudinally and transversely across the suspended ceiling while another embodiment provides spaced pairs of grid members only in a longitudinal direction of the suspended ceiling while single grid members extend transversely across such ceilings and interlock with the longitudinally extending spaced pairs of grid members and are in interlocking engagement therewith. An intersection clip means and associated intersection clip connector means is provided for establishing an intersecting, interlocking configuration for the former embodiment having transversely and longitudinally extending pairs of spaced, parallel grid members which further utilizes a bridging clip means for maintaining the appropriate assembled spacing of the parallel grid members at points removed from the aforesaid intersection clip means. The embodiment having pairs of spaced grid members extending only in the longitudinal direction across a suspended ceiling includes only a bridging clip means for mounting the pairs of grid members in an appropriate manner with the web walls of such grid members being apertured to receive the end portions of the single transversely extending grid members.

The foregoing and other objects, advantages, and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a perspective view of the embodiment of the present invention termed the "quad system" having longitudinally and transversely extending pairs of spaced, substantially parallel grid members.

FIG. 2 is a perspective view of the intersection clip means employed in the aforesaid "quad system" for providing an intersecting, interlocking relationship between the longitudinally and transversely extending grid member pairs;

FIG. 3 is a perspective view of an intersection clip connector means which is adapted to be snap-fitted onto the aforesaid intersection clip means shown in FIG. 2 and provides for connection of spaced, parallel pairs of grid members thereto;

Figure 5:
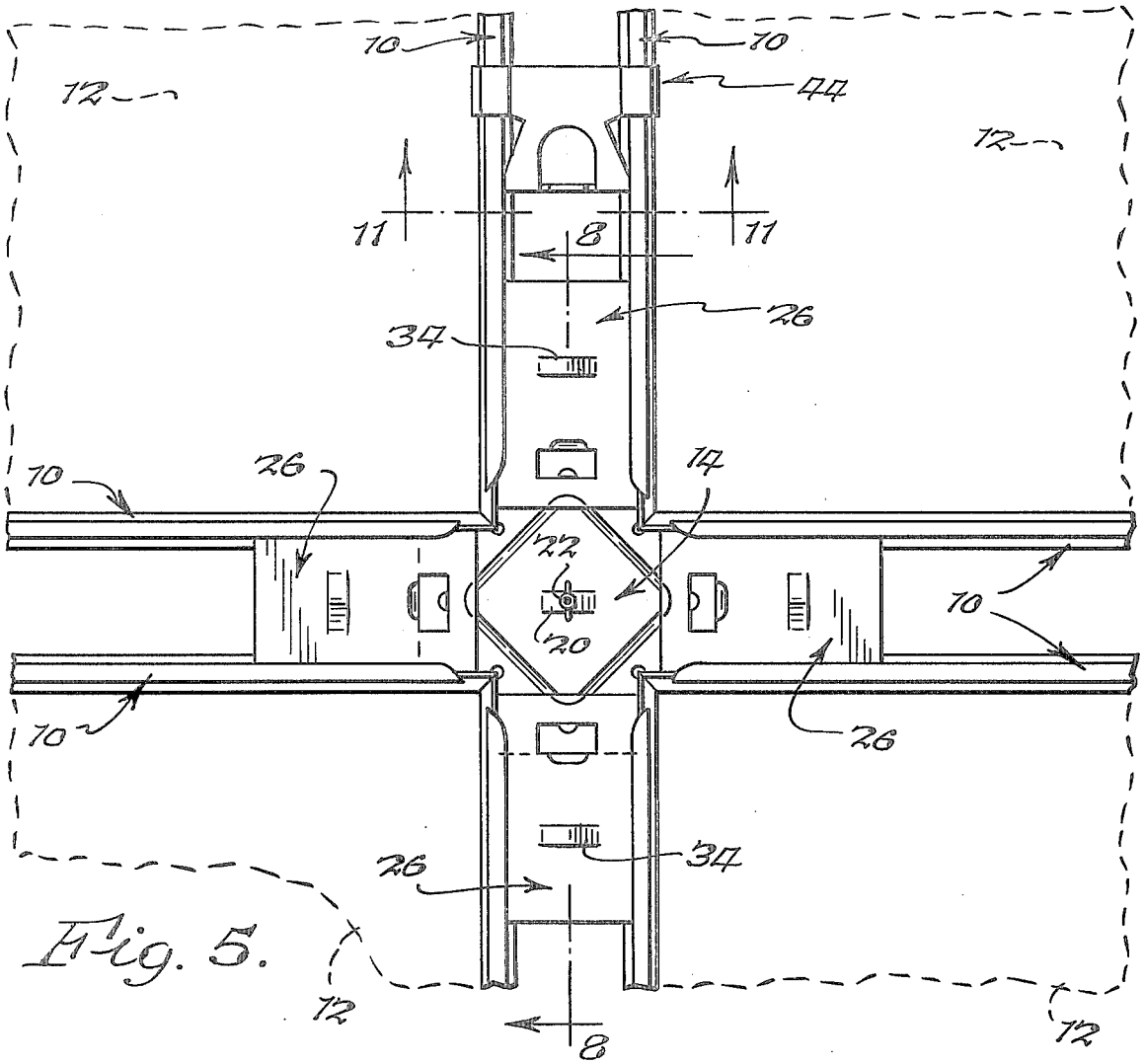
Figure 6:
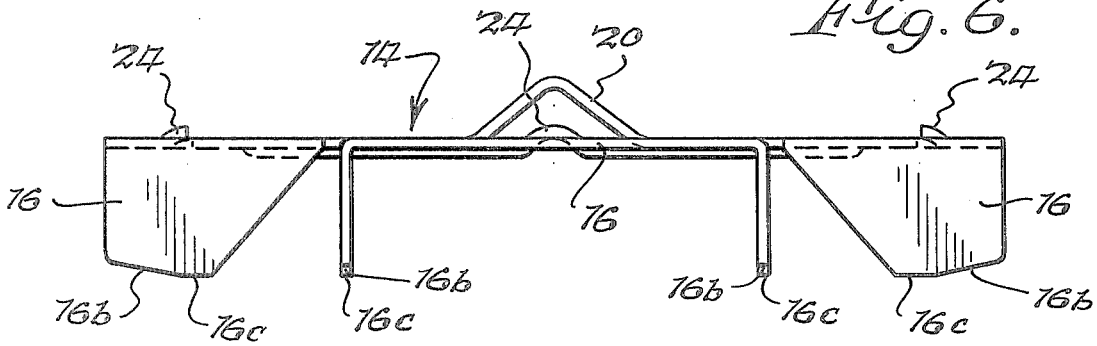
Figure 7:
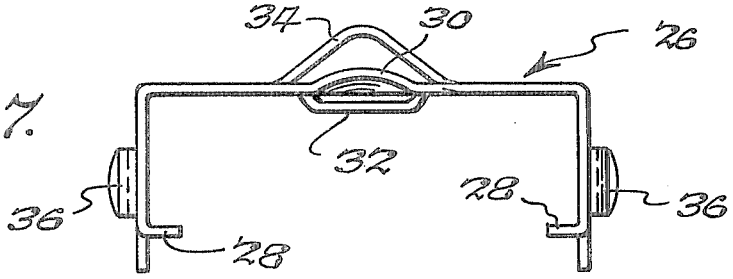
Figures 8, 9:
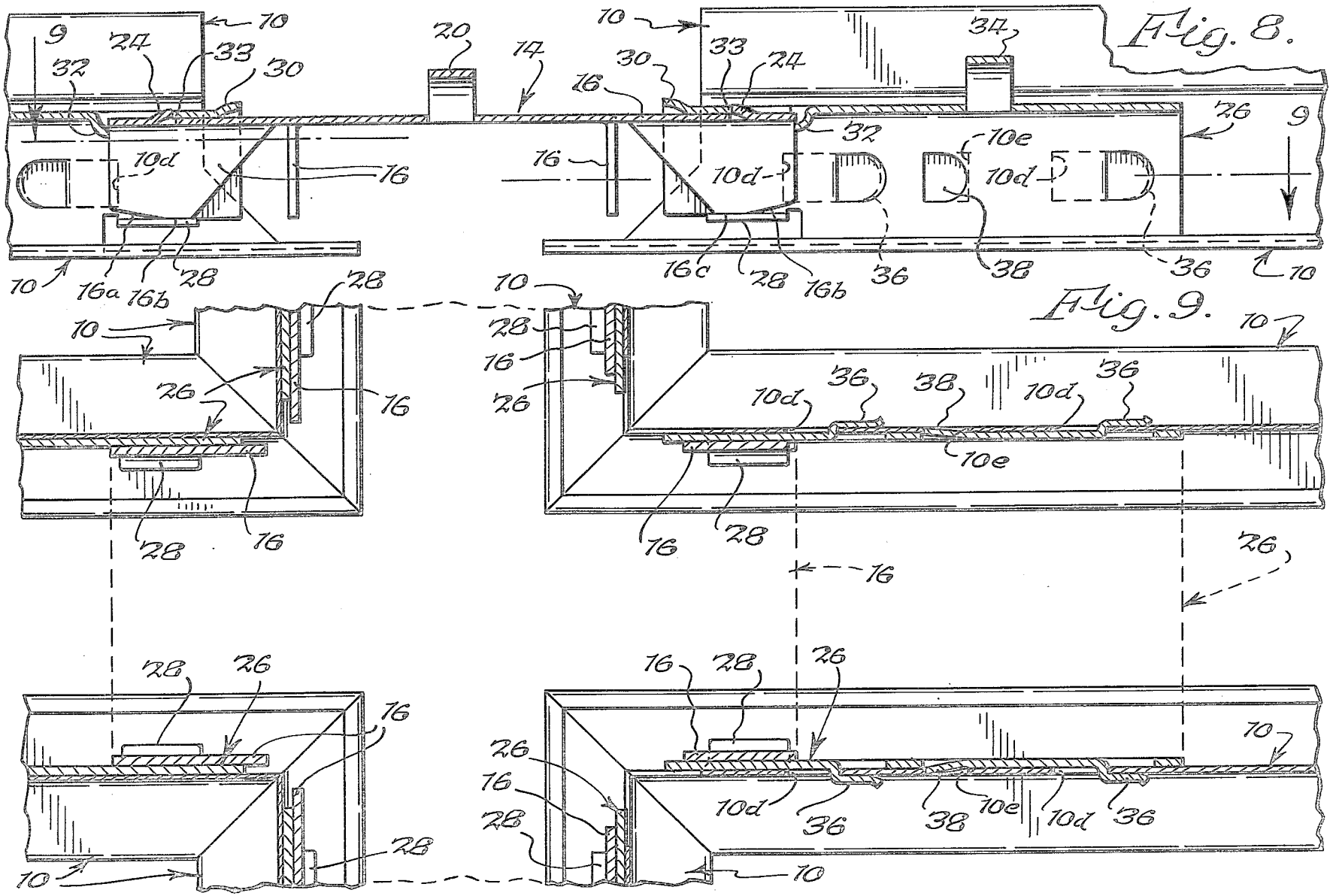
Figures 10, 11, 12:
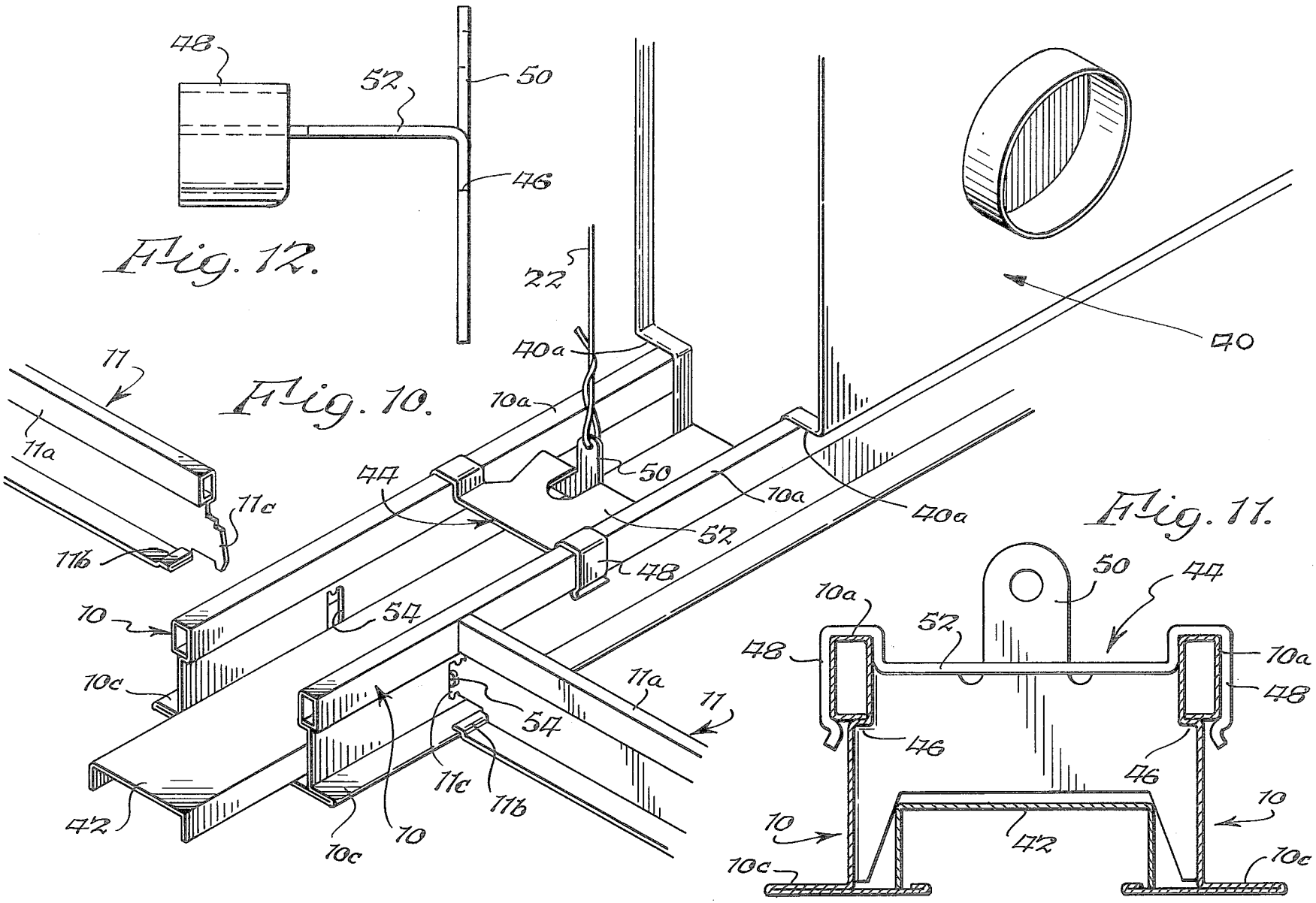
Figure 13:
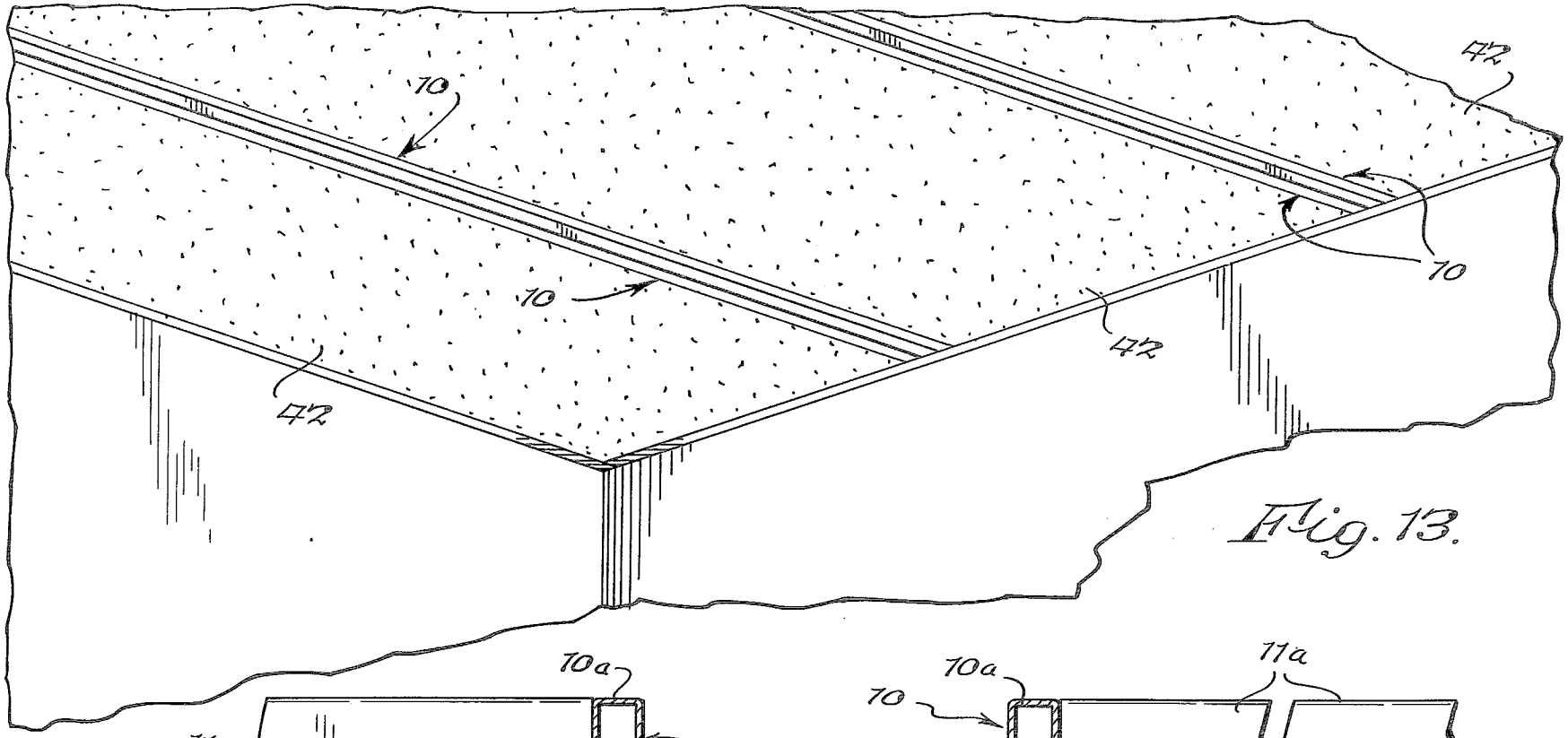
Figure 14:
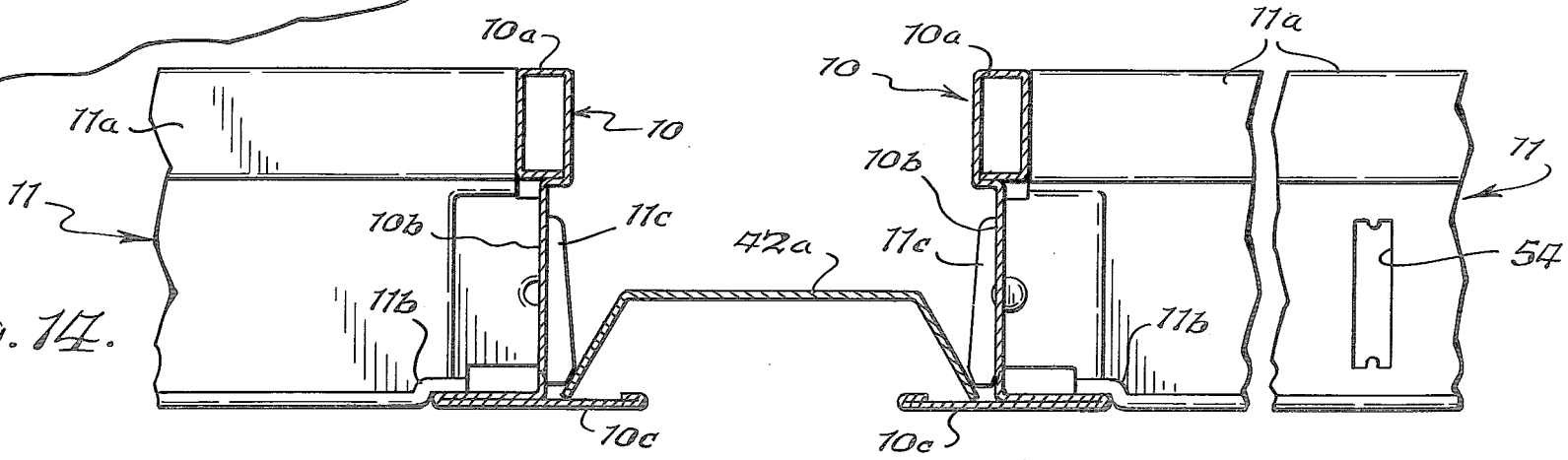

FIG, 4 is a perspective view of the end portion of a grid member which is adapted to be locked to the intersection clip connector means shown in FIG. 3 to form one of a pair of parallel grid members;

FIG. 5 is a top plan view of the "quad system" grid structure in assembled form;

FIG. 6 is a side elevational view of the intersection clip means shown in FIG. 2;

FIG. 7 is an end elevational view of the intersection clip connector means shown in FIG. 3 viewed from the end as adapted to be connected to the intersection clip means of FIG. 2;

FIG. 8 is a fragmentary longitudinal view in section of grid member, intersection clip means, and intersection clip connector means as taken about on line 8—8 of FIG. 5;

FIG. 9 is a fragmentary top view in section of an intersection clip means and four pair of spaced, substantially parallel grid members attached thereto as taken about on line 9—9 of FIG. 8;

FIG. 10 is a perspective view of the embodiment of the present invention termed a "linear system" including single, transversely extending grid members adapted to lock into apertures in the web portion of the longitudinally extending grid member pairs and which is shown to include a bridging clip means for supportably maintaining the parallel pairs of grid members in a spaced relationship. This view further shows an air handling conduit disposed between the parallel grid members along a portion of their respective lengths and a blankout means disposed to rest on the adjacent flanges of the parallel grid member portions not including the air handling conduit;

FIG. 11 is an end view of the bridging clip means shown in FIG. 10 as taken in section through the parallel grid members and blank out channel assembled therewith;

FIG. 12 is a side elevational view of the bridging clip means shown in FIG. 11 in non-assembled form;

FIG. 13 is a fragmentary perspective view of a suspended ceiling incorporating the "linear system" of the present invention; and FIG. 14 is a transverse view in section of a pair of grid members of the aforesaid "linear system" with end portions of transversely extending single grid members shown in fragmentary form connected to the aforesaid pair of parallel grid members with a blankout channel disposed on the adjacent flanges of the latter pair of grid members.

DETAILED DESCRIPTION OF PREFERRED EMBODIMENT

Referring now in detail to the illustrative embodiments depicted in the accompanying drawings, there is shown in FIG. 1, a ceiling tile supporting grid system generally referred to hereinabove as the "quad system". More specifically, the "quad system" includes a plurality of pairs of grid members 10 adapted to support a plurality of individual panel members 12 in a plane. The grid members 10 are arranged in spaced apart pairs with the grid members of each pair being substantially parallel to one another. As will be described in detail hereinbelow the pairs of grid members extend both longitudinally and transversely with respect to a room and are supported from an overhead superstructure of a building or the original ceiling of such area. Through use of the spaced pairs of grid members, the outlet portions of air handling conduits may be slip fitted into the upper spaced area between the grid member pairs. By use of the "quad system" with its longitudinally and transversely extending grid member pairs, it is possible to dispose air handling conduits over corresponding longitudinal and transverse areas of the suspended ceiling. In furtherance of this concept various connective elements are disclosed hereinbelow which enable a user thereof to use standard grid members having minimum modifications for use with such connective elements.

The rigid members shown in some of the figures and described as adapted for utilization in the grid systems considered herein are fabricated from a single piece of any suitable material, preferably an inexpensive, lightweight metal such as soft steel for example in a form to provide a generally vertical web section upstanding from laterally, projecting tile or panel supporting, load carrying flanges on opposite sides thereof and surmounted by a generally box shaped, longitudinally extending, reinforcing bead means. As seen in FIGS. 4 and 11, the bead means thereon can be viewed as being normally hollow and substantially rectangular in transverse cross section.

Turning to FIG. 2 of the drawings an intersection clip means 14 is illustrated which includes four channel shaped protrusions 16 extending therefrom and being spaced at substantially 90° with respect to one another. The intersection clip means provides for the intersection and interconnection of the transversely and longitudinally extending pairs of grid members of the "quad system" as shown in FIG. 1. The intersection clip means further includes reinforcing ribs 18 and a deformed suspension attachment portion 20 through which an appropriate hanging wire 22 may be assembled so as to affirmatively suspend the intersection clip means 14 from the overhead superstructure or original ceiling of a room. As further shown in FIG. 2, each protrusion 16 of the intersection clip means includes an upwardly deformed protrusion 24 which is formed to include an outer surface which slopes upwardly towards the center of the intersection clip 14.

The intersection clip connector means 26 is shown in FIG. 3 which is designed to matingly engage with a deformed portion 24 on protrusion 16. The connector 26 is also of channel shaped cross section and being of slightly greater width than a protrusion 16 is adapted to be slip fitted thereover as will be more fully described hereinbelow. The connector 26 further includes an inwardly bent shoulder portion on each of its lower edges for axial engagement underneath the lower edges of a mitered protrusion 16. In addition, the leading edge of the connector 26 includes an upwardly deformed portion 30 for camming engagement with the upper surface of the deformed portion 24 on protrusion 16 upon engagement of the connector means with such protrusion 16. A downwardly deformed protrusion 32 in the top surface of the connector means abuts against the axial end face or edge of a protrusion 16 to limit the axial engagement with respect to the connector means as will also be more fully described. Furthermore, an upwardly deformed notch 34 is provided in the top surface of the connector 26 which is similar to the notch 20 in the intersection clip means and which serves as an attachment means for a suspension wire if desired. Locking tab means 36 are provided on each side of the connector 26 and are oriented to open towards the far end of the connector as viewed in FIG. 3 for cooperative mounting of a grid member thereon.

In addition, an outwardly deformed camming surface 38 is formed on the sidewall of the connector 26 intermediate to the two locking tabs 36 as shown. As will also be more fully described the detent or camming surface 38 acts as a spring lock to hold a grid member in mounted engagement with the tabs 36.

A fragmentary end portion of a typical grid member as utilized in the "quad system" is shown in FIG. 4. As generally referred to hereinabove the grid member 10 includes a substantially vertical web means 10*b* and load carrying flange means 10*c* laterally outwardly of the web means. The bead means 10*a* surmounts the web means and is so formed to provide increased rigidity along the entire length of the grid member. The end portion of the web 10*b* further includes three punched out apertures. The apertures, indicated as 10*d*, are formed to cooperatively mate with the locking tabs 36 on connector 26 and the aperture indicated as 10*e* is formed to cooperatively engage with the detent 38 on connector 26. Furthermore, the end edge of flange means 10*c* is diagonally cut at an angle of substantially 45° so as to cooperatively abut a perpendicularly disposed grid member when in assembled form so that a beveled corner essentially exists between the adjoining flanges of perpendicularly intersecting grid members.

Turning now to FIGS. 5–9 the assembly of the aforesaid intersection clip means 14, intersection clip connector means 26 and the grid members 10 to form the "quad system" as seen in FIG. 1 will be described. As shown in top plan view form the intersection clip means 14 includes four intersection clip connector means 26 attached to the four protrusion portions 16 which necessarily extend outwardly from the intersection clip at 90° angles. Although only one suspension wire 22 is shown attached to the central portion of the intersection clip it would of course be possible to attach additional suspension wires to the suspension portions 34 on the connectors 26. The intersection clip 14 and connector 26 shown in FIGS. 2 and 3 in perspective form are shown in side and end elevation in the FIGS. 6 and 7, respectively. The specific attachment of connectors 26 to both the pairs of grid members 10 as seen in FIG. 5 and to the intersection clip will be described in detail with respect to FIGS. 8 and 9.

As shown in FIG. 8 the diametrically disposed protrusions 16 of the intersection clip 14 are received between the inner side of the top surface of the connectors 26 and the lower horizontally extending shoulder portions 28 thereof. As seen in detail in FIG. 6, the lower edge of protrusion 16 is formed to include an upwardly sloping leading edge 16*a* and a substantially horizontal lower edge portion 16*b*. Through use of this construction the sloping portion 16*a* facilitates insertion of the leading portion of the protrusion 16 into the intersection clip connector 26. During such insertion the upwardly formed detent portion 30 of the connector 36 cams over the locking protrusion 16 and the locking means 24 becomes aligned and snaps into the aperture 33 immediately in front of the downwardly deformed portion 32 on the top surface of the connector 26. The leading edge of the top surface of protrusion 16 accordingly abuts depression 32 to thereby limit further axial engagement between connector 26 and protrusion 16 while the upwardly biased protrusion 24 abuts the forward edge of aperture 33 so as to preclude axial disengagement of connector 26 from protrusion 16. When the connector 26 has been axially locked into position as described, the horizontal portion 16*b* of the lower edge of protrusion 16 is firmly seated on shoulder 28 so that a substantially tight vertical engagement exists between connector 26 and clip 14. As becomes readily apparent, the axial engagement of the connector 26 onto a protrusion 16 as shown in FIG. 8 is typical for the four protrusion connections of an intersection clip to connector means 26. As can be further appreciated the connector elements or means 26 and intersection clips 14 are formed as standard parts and are adapted for ready assembly in a grid system as envisioned in the "quad system" described herein.

The assembly of the grid members 10 onto the outer sidewalls of the connectors 26 will be described in conjunction with FIG. 9. Only the upper righthand portion of the FIG. 9 will be described in detail but it will be readily apparent to one skilled in the art that the connection of grid member 10 onto the outer sidewall of connector 26 is typical for the other connections of grid members 10 shown in FIG. 9 with such grid members being connected to the outer sidewalls of the four intersection clip connector means shown therein. As seen in the upper right hand portion of FIG. 9, the grid member 10 is assembled so that the outwardly opening locking tabs 36 on the sidewall of connector 26 extend through the apertures 10*b* in the web portion 10*b* of the grid member. Upon initial urging of the right hand edge of each aperture 10*d* beneath the leading edge of locking tab 36, the detent locking means 38 on the connector sidewall is forced inwardly into planar aligment with the sidewall of connector 26, since at this stage of assembly the aperture 10*e* in the web of the grid member would not be in axial alignment with the locking detent 38. Upon further axial urging of the grid member to the left as seen in FIG. 9, the righthand edge of the apertures 10*d* in the web portion thereof will abut the bottom of locking tabs 36 and the aperture 10*e* will become aligned with locking detent 38 so that the latter springs outwardly and abuts against the lefthand edge of aperture 10*e* as seen in FIG. 9. In this manner, the grid member will be locked firmly in axial engagement with the connector 26 in view of the engagement between detent 38 and the lefthand edge of aperture 10*e* on the grid member web and the bottoming out of the right hand edges of apertures 10*d* of the grid member web against the bottom of locking tabs 36. In addition, the lowermost edge 26*a* of the intersection clip connector means as seen in FIG. 8 is closely fit against the inwardly extending flange portion 10*c* of the grid member, which, coupled with the close vertical fit between the locking tabs 36 and apertures 10*d* of the grid member web provide for a rigid locking of the grid member to the connector means 26. As can be appreciated by one familiar with suspension ceilings, the ease with which the assembly of the aforesaid intersection clip, intersection clip connectors and grid members can be effected is highly desirable. In addition, it is to be noted as seen in FIG. 9 that the beveled end edges of the grid member flanges form a mitred type of corner with respect to the perpendicularly adjoining grid members.

The advantage of the spaced, parallel grid members 10 extending in longitudinal and transverse directions as seen in FIG. 5 can be appreciated when considered in conjunction with FIG. 10. As shown in FIG. 5, the ceiling panels or tiles 12 are disposed on the outer flanges 10*c* of the grid members thus leaving a void space between the inwardly extending portions of the grid flanges 10*c*. Accordingly, a primary feature of the present invention is the placement of air handling conduits 40 into communication with such void space. As shown in FIG. 10, a conduit 40 for conditioned air is narrowed at its lower end in order to snugly fit between the adjacent bead portions 10*a* of the grid members shown therein. It has also been found desirable to provide outwardly extending shoulder portions 40*a* on the air handling conduit so as to facilitate assembly of the conduit between the grid members. In other words, it is only necessary to take the conduit and force it downwardly between the grid members until the portions 40*a* abut the top of the bead portions 10*a*. Necessarily, the remaining portion of the conduit could be formed so as to be adaptable to any type of air handling system. The primary advantage of the "quad system" as shown in FIG. 5 of the drawings is the fact that air handling conduits 40 may be placed more selectively since it is possible to mount them in both longitudinal and transverse locations due to the nature of the "quad system".

As further seen in FIG. 10 of the drawings, it is also within the scope of the present invention to employ blank out channels 42 along those portions of the parallel grid members not housing an air handling conduit. As seen in FIG. 10, the blank out means 42 is channel shaped in cross section and simply rests on the inwardly extending flanges 10*c* of the grid members. Accordingly, a completed ceiling as generally seen in FIG. 1 can be formed which is pleasing in appearance since no voids will exist therein between the parallel grid members due to the assembled combination of air handling conduits and blank out means being disposed between the parallel pairs of such grid members.

Another version of the present invention is to be seen generally in FIG. 13 and has been termed a "linear system" for suspending ceiling panels or tiles. As generally shown in FIG. 13, longitudinally extending pairs of spaced, parallel grid members 10 are disposed above a room and ceiling tiles or panels 42 are mounted on the outwardly extending flange portions thereof. As will be readily apparent to the reader hereof, the "linear system" as to be described provides for placement of air handling conduits only in longitudinal direction along several longitudinally extending pairs of grid members. However, the "linear system" includes a pair of spaced, parallel grid members 10 which are maintained in such spaced position and are suspended by means of bridging clip 44.

The bridging clip 44 is shown in end view in FIG. 11 and in side view in FIG. 12. As shown in FIG. 11 the bridging clip means includes upstanding shoulder portions 46 and downwardly opening bead engaging portions 48. The portions 48 include an inner width dimension which substantially corresponds to the outer width of the bead means 10*a* of the grid members. In addition, as seen in FIGS. 11 and 12, bridging clip 44 includes a suspension attachment means 50, the latter being axially aligned with the shoulder portions 46, with both the shoulder portions and suspension means 50 being at the opposite end of the clip from the bead engaging portions 48. The two ends of the clip are joined by a horizontally extending body portion 52.

As further seen in FIG. 10, the web portions of the grid members utilized in the "linear system" include vertically extending slot portions 54 for receiving single transversely extending grid members 11 as seen in FIG. 10 also.

In assembling the "linear system" grid, standard lengths of T-bar 10 as shown in FIG. 10 may be assembled to bridging clips 44 which are spaced along the lengths thereof at desirable intervals such as every three to four feet for example. The bridging clips 44 are assembled by tilting the body portion 52 into an orientation generally about 45° with respect to the horizontal and by rotating the entire clip away from the longitudinal axis of the grid members while placing the clip between such grid members. Accordingly, the clip is rotated so that the shoulder portions 46 become aligned beneath the inner edges of the beads 10*a* and then the clip is rotated so that the body portion 52 tends toward a horizontal disposition with the bead engaging portions 48 becoming clamped over the beads 10*a* and simultaneously drawing the shoulder portion 46 upwardly beneath the inner edges of the beads of the grid members. As clearly shown in FIG. 11, the lower edge of the bead engaging portions is bent slightly inwardly so as to be biased against the outer wall of the bead portion 10*a* so as to insure a snug fit therewith. As can be further appreciated from FIG. 12, when a suspension wire is attached to portion 50 of the bridging clip the upstanding shoulder portions 46 are directly urged against the underside of the grid member beads so as to insure positive support thereto.

As seen in FIG. 10 and FIG. 14 single, transversely extending grid members 11 include end portions specifically adapted to engage the web openings 54 of the longitudinally spaced pair of grid members. The end of each grid member 11 includes a shoulder portion 11*b* which abuts against the outer edge of flange 10*c* so as to preclude axial movement of grid member 11 towards grid member 10 in conjunction with the abutment of beaded portion 11*2* with beaded portion 10*2*. Furthermore, the distal end of grid member 11 includes a downwardly hooked portion 11*c* which extends past the web 10*b* of the longitudinal grid member for only a minimum distance so as to avoid interference with the blank out channel means 42*a* shown in FIG. 14. Accordingly, the transversely extending grid membersll may be easily assembled to the longitudinally extending pair of grid members connected by the bridging clip 44 so that transverse support may be provided to ceiling tiles as commonly understood in suspended ceiling construction.

Returning now to FIG. 10, it can be easily understood that the "linear system" employs air handling conduits 40 in the same manner as does the "quad system" with respect to the spaced, parallel grid member arrangement. However, in the "linear system" parallel grid members are spaced and suspended by means of the bridging clip 44 and transverse support is provided to the ceiling tiles by the transversely extending, single grid members 11 which intersect and are interconnected to the grid members 10.

From the foregoing, it is apparent that the objects of the present invention have been fully accomplished. As a result of this invention, an improved grid system for suspended ceilings is provided whereby air handling conduits may be easily and effectively installed therein. In addition, the two versions of the grid system herein, namely the "quad system" and the "linear system" include a minimum number of elements which are easily and readily assembled to one another so as to be subject to efficient construction procedure.

We claim:

1. A grid system having a plurality of pairs of grid members adapted to support a plurality of individual panel members in a plane and further being adapted to receivably mount air handling conduits between any adjacent pair of said grid members at preselected locations along the longitudinal length thereof, said grid system comprising:

an intersection clip means, said intersection clip means having a plurality of locking connectors extending therefrom in a predetermined geometric relationship;

a plurality of grid members, each of said grid members being ridigly assembled to one of said locking connectors of said intersection clip means so that a plurality of pairs of grid members extend from said intersection clip means wherein said grid members of each of said pair are substantially parallel to one another and are adapted to support panel members on the non-adjacent sides thereof and air handling conduits between the adjacent sides thereof.

2. A grid system as set forth in claim 1 wherein said intersection clip means has extending therefrom four pair of said locking connectors disposed in a horizontally co-planar manner about the periphery of said intersection clip means wherein each adjacent pair of locking connectors are oriented substantially 90 degrees apart from one another.

3. A grid system as set forth in claim 2 wherein said intersection clip means includes four intersection clip connector means, each of said intersection clip connector means having two ends and being rigidly assembled to said intersection clip means on one end and having a pair of grid locking means on the other of said ends in locked connection with a pair of said grid members.

4. A grid system as set forth in claim 3 wherein said intersection clip means includes four channel shaped protrusions for assembly with said intersection clip connector means and said intersection clip connector means being channel shaped in cross-section are telescopically mounted on corresponding said channel shaped protrusions in an axial manner and each mounted pair of intersection clip protrusions and intersection clip connector means having cooperating, snap-fit locking elements so as to maintain each said intersection clip connector means in a rigid mounted relationship with said intersection clip means.

5. A grid system as set forth in claim 1 wherein each of said grid members includes a substantially vertical web means and load carrying flange means extending laterally outwardly of said web means, and a bead means surmounting said web means and providing increased rigidity to said grid member.

6. A grid system as set forth in claim 5 wherein each of said pair of parallel grid members are spaced from one another so as to be adapted to receive an air handling conduit between said respective bead means thereof.

7. A grid system as set forth in claim 6 being in combination with at least one air handling conduit, said conduit being receivably mounted between a pair of said grid members and further including blank out means disposed on adjacent flange means of each pair of said grid members along those portions thereof not in combination with said air handling conduit means.

8. A grid system as set forth in claim 4 wherein each said grid members includes a vertical web means and load carrying flange means extending laterally outwardly of said web means, and a bead means surmounting said web means to provide increased rigidity to said grid member, and each end portion of each said grid member assembled to one of said grid locking means having at least one opening in said web means thereof and each said grid locking means comprising a tab portion formed outwardly from said intersection clip connector means wherein said tab means engages said opening in said web means in a snap fit manner so as to maintain said corresponding grid member in a rigid assembled disposition with respect to said intersection clip connector means.

9. A grid system adapted to support a plurality of individual panel members in a plane and being in combination with an air handling conduit between said panel members, said grid system comprising:

at least one pair of spaced grid members being substantially parallel to one another, at least one bridging clip means, said bridging clip means being assembled to said pair of grid members to maintain the latter in a substantially parallel, spaced disposition with respect to one another so that said pair of grid members are adapted to support panel members on the non-adjacent sides thereof and air handling conduits between the adjacent sides thereof at preselected locations along the longitudinal length thereof.

10. A grid system as set forth in claim 9 wherein each of said grid members includes a substantially vertical web means and load carrying flange means extending laterally outwardly of said web means, and a bead means surmounting said web means, the latter providing increased rigidity to said grid member.

11. A grid system as set forth in claim 10 further including at least one transverse grid member disposed substantially perpendicular to said pair of spaced parallel grid members and being connected in abutting relationship to the side of one of said parallel grid members.

12. A grid system as set forth in claim 10 wherein each of said pair of parallel grid members is spaced from one another so as to be adapted to receive an air handling conduit between said respective bead means thereof.

13. A grid system as set forth in claim 12 being in combination with at least one air handling conduit receivably mounted between one pair of said grid members and further including blank out means disposed on adjacent flange means of each pair of said grid members along those portions thereof not in combination with said air handling conduit means.

14. A grid system as set forth in claim 10 wherein said bridging clip means includes two upstanding shoulder portions and at least one longitudinally spaced, downwardly opening bead engaging portions, said latter portion being engaged over one of said grid member bead means so that said shoulder portions are respectively disposed below said grid member bead means.

15. A grid system as set forth in claim 14 wherein said bridging clip means further includes a suspension attachment means longitudinally disposed on said bridging clip body so that during suspension of said grid system said shoulder portions are urged upwardly to abut and support said respective bead means of said grid member pair.

16. A grid system as set forth in claim 15 further including at least one transverse grid member disposed substantially perpendicular to said pair of spaced parallel grid members and connected in abutting relationship to the side of one of said parallel grid members.

17. A bridging clip means adapted to supportably connect a pair of grid system members in a spaced substantially parallel manner, each grid member having a web means and load carrying flange means extending laterally outwardly of said web means, and a bead means surmounting said web means to provide increased rigidity to said grid member, said bridging clip means comprising:

two upstanding shoulder portions and at least one longitudinally spaced, downwardly opening bead engaging portion, said latter portion being adapted to be engaged over a grid member bead means.

18. A bridging clip means as set forth in claim 17 further including a suspension attachment means longitudinally disposed on the body of said bridging clip means so that during suspension of said bridging clip means, said shoulder portions thereof are urged upwardly to abut and support said respective bead means of said grid members.

19. A grid system as set forth in claim 2 further including at least one bridging clip means being assembled to one of said pair of grid members to maintain the latter in a substantially parallel, spaced disposition with respect to one another.

20. A grid system as set forth in claim 19 wherein said bridging clip comprises:

two upstanding shoulder portions and at least one longitudinally spaced, downwardly opening bead engaging portion, said latter portion being adapted to be engaged over a rigid member bead means.

21. A grid system as set forth in claim 20 further including a suspension attachment means longitudinally disposed on the body of said bridging clip means so that during suspension of said bridging clip means, said shoulder portions thereof are urged upwardly to abut and support said respective bead means of said grid members.

* * * * *

UNITED STATES PATENT AND TRADEMARK OFFICE

CERTIFICATE OF CORRECTION

PATENT NO. : 4,019,300

DATED : April 26, 1977

INVENTOR(S) : Gale E. Sauer and Barton Hansen

It is certified that error appears in the above-identified patent and that said Letters Patent are hereby corrected as shown below:

Claim 1, line 10, "ridigly" should be --rigidly--.

Claim 20, line 11, "rigid" should be --grid--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*